United States Patent [19]

Bühler

[11] 4,182,395

[45] Jan. 8, 1980

[54] METHOD AND DEVICE FOR THE PRODUCTION OF CASTING MOLDS OUT OF SAND CONTAINING A BINDER

[76] Inventor: Eügen Buhler, 96, Weg Zur Walk, 8871 Burtenbach, Fed. Rep. of Germany

[21] Appl. No.: 855,395

[22] Filed: Nov. 28, 1977

[30] Foreign Application Priority Data

Nov. 26, 1976 [DE] Fed. Rep. of Germany ..... 2653788

[51] Int. Cl.[2] ..... B22D 15/22

[52] U.S. Cl. ..... 164/7; 164/40; 164/160; 164/200; 164/38; 164/195

[58] Field of Search ..... 164/7, 19, 21, 160, 164/253, 200, 202, 201; 302/48, 53, 57, 59, 23; 222/193; 141/8, 59, 67

[56] References Cited

U.S. PATENT DOCUMENTS

| | | | |
|---|---|---|---|
| 1,524,922 | 5/1925 | Formaneck | 222/429 |
| 2,079,802 | 5/1937 | Hauk | 222/485 |
| 2,511,089 | 6/1950 | Zahner | 222/485 |
| 2,642,206 | 6/1953 | Reed | 222/429 |
| 2,933,785 | 4/1960 | Hansberg | 164/160 |
| 3,260,285 | 7/1966 | Vogt | 141/8 |
| 3,290,733 | 12/1966 | Miller | 302/53 |
| 3,556,196 | 1/1971 | Bühler | 164/40 |
| 3,807,483 | 4/1974 | Bühler | 164/167 |
| 4,016,994 | 4/1977 | Wurster | 302/23 |

FOREIGN PATENT DOCUMENTS 4530 of 1896 United Kingdom ..... 222/429

*Primary Examiner*—Robert D. Baldwin
*Assistant Examiner*—K. Y. Lin
*Attorney, Agent, or Firm*—Holman & Stern

[57] ABSTRACT

Casting molds from binder-containing molding sand manufactured by improved vacuum injection, achieved by employing an injection grate with injection slots of a minimum width of at least 50 mm, a filterless connection between the mold container, the vacuum container and a vacuum container having a volume at least 20 times the volume of the mold container, evacuation of the vacuum container by a liquid seal pump and a venturi pipe effect in the sand chamber prior to injection of the sand.

36 Claims, 4 Drawing Figures

METHOD AND DEVICE FOR THE PRODUCTION OF CASTING MOLDS OUT OF SAND CONTAINING A BINDER

BACKGROUND OF THE INVENTION

The instant invention concerns a method of manufacturing casting molds from a molding sand which contains a binder.

Such a method is disclosed in the prior art in German Pat. No. 2,403,199.

The manufacture of sand casting molds by means of mold machines has in the prior art been accomplished by means of jolting, mechanical pressing, a combination of jolting and pressing, multiple pressing, pressing with elastic pressing units with a membrane, blowing the mold sand into the form box with a subsequent mechanical secondary compressing or by means of high pressure interleaving with a subsequent mechanical secondary compression. In addition, the molding sand interleaving in the form boxes by means of vacuum is described in German Pat. No. 1,097,621.

During the jolting, the unpleasant noise is particularly disruptive. The mechanical pressing, even through producing little noise, will usually result in uneven compressions. Multiple pressing machines have the disadvantage of producing an uneven back surface of the mold. The same holds true in molding with an elastic compression unit. The blowing of the molding sand into the mold box, particularly the lateral blowing into the mold box, has the disadvantage of a sand blast blower effect and results in excessive wear of the mold; additionally, there results thereby at leaky points a strong stress on the surrounding area due to the scattering of sand particles and dust. The scattering of sand particles and dust also results during superatmosphere pressure injection of the molding sand into the mold box, even though this method has been recently improved to such an extent that there results a substantially improved and a more even sand compression compared to earlier results. A still further advancement in this improvement could be made by means of mechanical secondary compression. Unfortunately, during superatmospheric pressure injecting of the form box, it is impossible to avoid a noticeable noise stress on the surrounding area.

In many of the above methods, there is additionally noted the disadvantage that generally the greatest hardness is obtained at the backside of the mold, where the mold is not being utilized to such a great extent. While close to the pattern form areas, which are located near the partial plane, where due to the desired high precision of the form contours, the greatest form hardness is desired, have a lower degree of hardness due to the sand friction on the model. Additionally, forms which have been pressed under high pressure show especially an extensive "spring-back resilience effect" which during and after the consequent countersinking is considered to be an interferring factor.

The above-mentioned German Pat. 2,403,199 discloses an superatmospheric pressure injection method, in which the molding sand being injected into a form box or form frame by means of a grate whereby the second opening of the sand box, which faces away from the sand chamber, is sealed by means of a hollow pattern plate, the inside of which on one side being connected with the form box or form frame space by means of evacuation nozzles, and on the other side is connectable to a vacuum source by means of an evacuation pipe, whereby after the injection of the molding sand into the form box or form frame the molding sand which has already been precompressed by means of the injection will be consequently compressed by means of the pressing plate.

The evacuation of the model plate in this prior art method is mainly for the purpose of removing the injection air from the form box or form frame, and to thereby support and optimize the superatmospheric pressure injection process. The prior art method is thus not a pure vacuum injection method in the sense of the instant invention.

Even though this prior art method has proven to be successful, it has the disadvantage that during the injection of sands of an overall satisfying quality for the form, from the top downward, the sand which is located in the sand chamber, which strongly widens in the "venturi widening" tends to harden, which will result in the formation of a crater during the injection in the venturi neck.

The crater formation in the venturi neck also appears during the working of normal sands when the horizontal measurements of the venture-neck exceed a predetermined dimension.

Due to hardening of the sand in the venturi widening section and in the limited horizontal dimensions of the venturi neck, it was not possible to produce very large form sections with this prior art method.

The vacuum injection as described in German Pat. No. 1,097,621 would not only offer the advantage of very limited noise stresses, but, due to its small degree of air inclusion, it would also open up the possibility of reducing the above-mentioned "spring-back resilient effect". In practice, however, the form described in the above-mentioned patent, could not be entirely accepted, and it functions, especially not in the working of molding sands with a high inner binding power and clay-containing sands in a quality according to hand-forming.

SUMMARY OF THE INVENTION

It is an object of the instant invention to improve the method described in German Offenlegungsschrift No. 2,403,199 by reducing to practice the theoretical proposal of injecting molding sand into a mold box or mold frame by means of vacuum, and to thereby generally realize a substantially improved working method compared to all prior art methods in technical, economic and environmental respects. Therefore, it is most of all desired to prevent the above individually explained disadvantages which are inherent in the prior art methods, namely, the uneven form hardness, the fissures in the back side of the mold, the excessive "spring-back resilience effect", the noise stress, and other environmental stresses due to floating dust and sand particles or dust-containing used air.

The inventive method provides an improved vacuum injection method for clay-containing molding sands with a substantially lower energy consumption and without noise, floating sand particles and dust interferring with the environment. It is now possible to manufacture sand molds having a substantially more even hardness, whereby the mold hardness in the partial plane and in the close to the pattern form areas therein, which is as great or even greater than the hardness of the level back side of the mold, and wherein the "spring-back resilience effect", which is so annoying during the sinking, is tremendously reduced.

This is especially true with regard to the manufacture of individual molds, i.e., of mold sections. In addition to the disadvantages during the manufacture of individual molds, there exist also further problems with regard to the manufacture of complete casting molds comprising such mold sections which are commonly manufactured separately and are then joined, except in machines having bilaterally-applicable pattern plates.

According to the prior art methods, if one does not consider the turn over device, there existed hereby, in general, only the possibility of filling the individual forms from the top, molding, and then turning over the forms which are considered as bottom portions, sinking, then also turning over the molds which are proposed as upper sections when the cores should be inserted after the sinking, inserting the cores, again turning over the mold and then joining. In case of the core insertion into the upper section of the mold, the prior art methods required three turning phases, which, naturally, required a great amount of time and machinery. Also, in this regard, it became necessary to look for better solutions to the problem.

The inventive method therefore provides a new way with regard to the completion of individual molds into complete casting molds.

An evacuating of the mold box or mold frame area for the purpose of injecting by vacuum thereinto is disclosed in the above-mentioned German Pat. No. 1,097,621. The apparatus disclosed in the afore-mentioned patent shows comparatively long evacuation ducts of small cross sections, a control valve with a small passage cross section, and in the mold box or in the pattern plate there are provided only a few evacuation nozzles, which are connected to branch ducts also having a small cross section. In the evacuation duct between the mold box and the control valve there is arranged a sand separator, which only increases the disadvantages with regard to the already very restrained air removal from the mold box area. Even though the expert in the art is offered the simple solution of making the cross section of the evacuation ducts and the branch ducts as well as the control valve in a correspondingly large size, however, the increase in the number of evacuation nozzles in the mold box and especially in the pattern plate which are offered as one idea in connection with such a type of method, would represent an unbearable cost factor, if in practical operation with such machines a large number of pattern plates would have to be supplied with an evenly large number of evacuation nozzles.

The air which is pumped from the mold box area in these prior art machines moves into a vacuum container which is arranged in the machine frame, and must be delimited due to its spatial dimensions.

In contrast to the vacuum injection method disclosed in the German Pat. No. 1,097,621, it is proposed in the instant inventive method that the hollow space of the form box be filterlessly connected with a large vacuum container of at least 20 times the volume of the form box hollow space by means of extraction openings having a total cross section in $cm^2$ corresponding at least with the extraction volume in liters, and be initially evacuated to a vacuum of at least 0.08 atmospheres, and that the large scale vacuum container is being continuously evacuated by means of a liquid seal pump. This makes it possible to make the cross sections of the evacuation duct and of the control valve arranged therein considerably larger, and to thereby extensively prevent an interferring throttling of the air to be removed in its path from the mold box or mold frame area to the large scale vacuum container. According to the invention, the sand shall be confined in the sand chamber by Venturi-effect to a cross-sectional area of about 1000 $cm^2$ to 2000 $cm^2$ before penetration through the injection grate. Tests with an inventive embodiment of the low pressure vacuum injection device have additionally shown the surprising result that in such types of air removals from the mold box or mold frame area it is not at all necessary that the number of evacuation nozzles in the pattern plate be extremely large. There suffices a number of nozzles which, normally, can easily be placed near the inner rim of a pattern plate carrier surrounding the pattern plate in a frame-like manner, so that on the actual pattern plate and in the pattern area only a few or even no evacuation nozzles need to be available, preventing thereby an increase in the costs of the pattern plates.

The tests have further shown that it is possible with the inventive method to manufacture very large mold sections. Especially in combination with the mounting of the evacuation nozzles near the rim of the pattern plate support, the utilization of the inventive venturi acceleration effect is especially favorable since it is directed towards the center, while the air to be pumped out flows towards the edge of the pattern plate.

The tests with the inventive installation have further shown that the slots in the injection grate of a width of at least 50 mm substantially ease the returning to the sand chamber of a portion of the molding sand, which was injected into the mold box or mold frame, during the subsequent mechanical secondary compression when using this injection grate as a pressure plate which contributes substantially to obtaining an even hardness of the mold. This minimum width of the injection slots makes it possilbe in cases of injection in an upward direction (i.e. from the bottom to the top) to permit an empty space of about 6 cm to 12 cm between the injection grate and the upper edge of the molding sand still located in the sand chamber after injection, whereby during the subsequent mechanical compression of the molding sand, enclosed in the mold box or mold frame, the afore-mentioned return of a portion of the enclosed molding sand to the sand chamber is far easier.

A special advantage of the inventive method is the separate optimum manufacturing of upper and lower sections of horizontally separated sand molds whereby various optimum variants for the completion into the total casting mold are offered.

It is possible to combine upper and lower sections, after the counter sinking, whereby the decisive advantage is achieved in that the lower section does not need to be turned over again.

There is also provided the possibility of manufacturing the upper section according to the same method by which the lower section is produced. This results in the advantage that the upper section, coming from the machine, is ready for inserting the core without the need of being turned over, and being blown out. It is thereby only necessary for the upper section to be turned over once for the purpose of combining, instead of needing to be turned over twice, as this has been the case in the prior art.

The two above-mentioned variants may be utilized for the manufacture of flaskless molds, with minor changes of the machines, whereby also herein it is of an advantage that the upper section is easily accessible for insertion of the core and the blowing-out phase.

Both methods of manufacturing the upper and the lower sections may be combined into one single machine according to the prior art match plate construction with a horizontally reciprocating pattern plate, whereby the requirement for space is substantially reduced.

If one compares the inventive method for vacuum injecting mold sections from the top toward the bottom with the method disclosed in German Pat. No. 1,097,621, then there results, with regard to the inventive method, at first the fact that it is only possible by this means to enable the injection of clay-containing sands in its entire range. There result additionally the following advantages:

In cases of injecting mold sand in a downward direction (ie from top to bottom), the inventive controlled closing of the injection openings of the injection grate before the molding sand is filled into the sand chamber, the consecutive evacuation of the mold box or mold frame area, and the injection of the molding sand into the mold box or mold frame by means of the controlled opening of the injection holes, it becomes possible, without difficulty, to evacuate the mold box or mold frame area before the injection to at least 0.2 atmospheres sub-atmospheric pressure so that during the opening of the injection holes there takes place an actual instantaneous effect of the vacuum which exists in the mold box or mold frame area in the sense of a distinguishingly favorable acceleration of the molding sand to be injected into the mold box or mold frame.

This represents a tremendous advancement compared to the method disclosed in German Pat. No. 1,097,621 in which the elastic sand-restraining members which are arranged in the injection holes permit the air to enter the mold box area before the beginning of the injection phase through the molding sand volume located in the sand chamber, and consequently to prevent its effective evacuation, and then during the injection to interfere with the molding sand penetration through the injection holes, so that there does no longer exist a true instantaneous vacuum injection. In general, tests with injection holes according to the German Pat. No. 1,097,621 have proven that this method tends to produce clogging.

Were one not to utilize the interferring sand-restraining members of elastic material from the injection openings, as in the machine described in German Pat. No. 1,097,621, then the injection openings would have to be narrowed to such an extent that, before the injection, no molding sand by itself would fall from the sand supply container into the form box area. Nevertheless, there would result, in the sand supply chamber during the injection, a crater formation which would make a continued injection impossible (see the article by R. L. Geller and V. I. Poplavskij "On the Working Manner of the Sand Injection Machines" published in LITEJOIE PROIZVOSTVO in German, 1965, No. 9, pages 23 to 26).

By means of the inventively controlled closing of the injection holes before the molding sand is filled into the sand chamber, in contrast to the elastic, automatic sand-restraining members described in German Pat. No. 1,097,621, there is safely prevented an unintentional emerging of molding sand from the injection holes, and also a guaranteed high degree of evacuation of the mold box or mold frame. Additionally, it is thereby also possible to make the injection openings selectively wide, which, with regard to preventing the above-mentioned damaging crater formation and obtaining of a large sand acceleration during the injection, provides a favorable return of a portion of the sand layer near the injection grate through the injection holes into the sand chamber during the mechanical consecutive compression of the injected sand fill.

The inventive method also provides for a most favorable venturi acceleration of the molding sand in the sand chamber during injection and ventilation of the sand chamber during injection of upper mold sections. This is especially the case if the molding sand, during the additional molding acceleration is confined to a path which is at least $\frac{1}{4}$ as long as the circumference of the confinement (i.e. the venturi neck).

The combination of venturi acceleration and sand chamber ventilation in connection with superatmospheric pressure injection is disclosed in German Pat. No. 2,403,199.

As already mentioned above, in this prior art superatmospheric pressure injection, the manufacture of larger molds produces difficulties not only in the utilization of sands of a rampant mold quality, but also normal sands, which, among others, are caused in that the sand, in case of a horizontally increased lower venturi widening, tends to harden, and also because the size of the venturi neck is delimited in its horizontal dimension.

The above difficulties are eliminated by the instant invention in that (1), the venturi restraint of the sand flow is brought into a predetermined relationship to the axial length of the restraint, (2) the accelerated form sand, after flowing through the venturi neck is allowed to engage the walls anywhere below the venturi neck, (3) the amount of sand below the upper edge of the venturi neck is brought into a predetermined relationship to the volume of the form box or form frame and (4) the sand located in the sand chamber is charged in a very certain manner with air currents of smaller or larger cross-section volumes, so that there develops a pressure difference which, especially in the area above the venturi neck, prevents a rupture of the sand flow during the injection. Preferably, the volume of sand in the sand chamber is at least $1\frac{1}{2}$ times the volume of the mold container during the application of the inventive steps, the molding sand flows during the injection into the form box or form frame generally perpendicular from the top to the bottom. The molding sand obtains horizontal components of motion in the area of the lower venturi widening, however, only during the supplemental sand flow from the top, and these horizontal components of motion have no longer a damaging effect, and even prevent the formation of air pockets in the venturi widening area which could controlably influence the air currents being applied to and penetrating the molding sand located in the sand chamber which cause the above-mentioned desired pressure differences. In cases where the sand chamber is open at the top, the upper edge of the sand volume located in the sand chamber should be situated about three times as high above the uppermost lateral air intake openings of the sand chamber (distance b in FIG. 1) as the horizontal (radial) distance of these air intake openings is from the circumference of the venturi (distance a in FIG. 1) neck.

In cases where the sand injection is performed in an upward direction (i.e. from the bottom toward the top) it has to be considered that the mold box or frame is in such cases above the sand chamber and the injection holes of the mold have to be retained open according to this invention. In these cases the vacuum has to be applied to the mold box or mold frame in two phases, i.e., at first only a weak vacuum is applied which effects a lifting of the sand volume located in the sand chamber up to the injection grate and to a small extent above it, so that the molding sand already in small amounts enters the injection holes, whereafter suddenly the vacuum increases to a high value, and the injection process is thereby initiated. Also with this method, a consecutive mechanical compression of the molding sand having been injected into the form box or form frame, is provided and according to this method a portion of the sand layer close to the injection grate is permitted to return through the extensively wide injection holes of the injection grate to the sand chamber.

The mold sections manufactured in this manner show extreme advantages similar to those mold sections manufactured by injection from the top toward the bottom, compared to the molds or mold sections manufactured according to prior art methods, with regard to especially good evenness in their hardness and solidity over all mold areas.

With the injection from the bottom to the top, the force of gravity of the molding sand located in the sand chamber will in any case reduce an uncontrolled overflow of molding sand from the sand chamber through the injection holes into the mold box or mold frame, the injection holes do not require a controlled sealing means (as described above for injection in a downward direction) and the injection holes may practically be so wide as the vacuum, which is applied to the mold box during the mechanical compression, would permit, and which, as a counter force, will retain the sand in the injection slot.

In the inventive vacuum injection from the bottom to the top there is utilized a sand chamber which is almost U-shaped in cross section, and which is known in its basic form in connection with the superatmospheric pressure injection, for example, from German Pat. No. 1,941,736, or from the German Offenlegungsschrift No. 2,403,199. Also when injecting the sand in an upward direction ventilating the sand chamber and, thus, creating the above-mentioned pressure difference, represents one of the most important requirements for an undisrupted continuous operation, since sand hardening is hereby eliminated, which over a longer period of time would lead to a clogging of the sand chamber.

The injection from the bottom to the top is applicable also for the manufacturing of upper mold sections of horizontally divided sand forms in which case, after the core insertion for the combining phase, the upper section must be turned over only once.

Since it is possible with the inventive vacuum injection method to inject from the top to the bottom as well as from the bottom to the top, it is entirely possible to manufacture the upper and the lower mold sections of horizontally divided molds on separate machines, and to combine the same afterwards. Thus, it is possible to combine a mold upper section, which has been injected from the top to the bottom, and a bottom section of the mold having been injected from the bottom to the top, in the known manner, into one complete casting mold. Finally, it is obviously also possible to combine a mold upper section which has been injected from the bottom to the top and a bottom section of the mold, after turning over the first one, into a complete casting mold. By means of these possible variants of the manufacture of mold sections, and the possibility to distribute the same to multitude of machines, there results organizational simplification with regard to the combining as well as with regard of inserting the core.

The inventive method may be utilized for manufacturing horizontally divided boxless sand molds according to the match plate principle which is disclosed in German Pat. No. 1,941,736 and in German Offenlegungsschrift No. 2,403,199.

The instant invention additionally contains a device for performing the inventive method which has at least one venturi pipe-shaped sand chamber, which is provided with an injection grate which in the form of a pressure plate effectively fits into the opening of a mold box or mold frame. The apparatus additionally is provided with a hollow pattern plate which boards to the other opening of the mold box or mold frame, the inside of which, on one hand, being connected with the form box or form frame chamber via evacuation nozzles, and on the other hand being connectable to a vacuum source by means of an evacuation duct and a control valve, and the pressure plate and pattern plate being displaceably arranged relative to each other. These characteristics are identical with a superatmospheric pressure injection machine described in the German Offenlegungsschrift No. 2,403,199. The inventive apparatus differs from this prior art machine through the combination of the following characteristics:

(a) the grate slots of the injection grate have a width of at least 50 mm, (b) the pattern plate can be inserted into the mold box or mold frame and the evacuation nozzles of the pattern plate are located near the rim of the pattern plate, (c) the cross section of the evacuation duct, measured in square centimeters, is at least as large as the measurement measured in liters of the form box or form frame volume, (d) the vacuum source is a vacuum container constructed as a large container, having a capacity of at least 20 times the mold box or mold frame volume, and is additionally provided at its lowermost point with a sand or dust collecting recess with a continuous or intermittent sand or dust removal; and the container being connected to a liquid seal pump, and (e) an air filter is arranged in the evacuation duct between the large scale vacuum container and the liquid seal pump in the evacuation duct.

BRIEF DESCRIPTION OF THE DRAWINGS

Some preferred embodiments of the inventive apparatus or individual sections thereof, will now be described in detail under reference to the drawings, wherein.

DETAILED DESCRIPTION OF THE PREFERRED EMBODIMENTS

Figure 1:
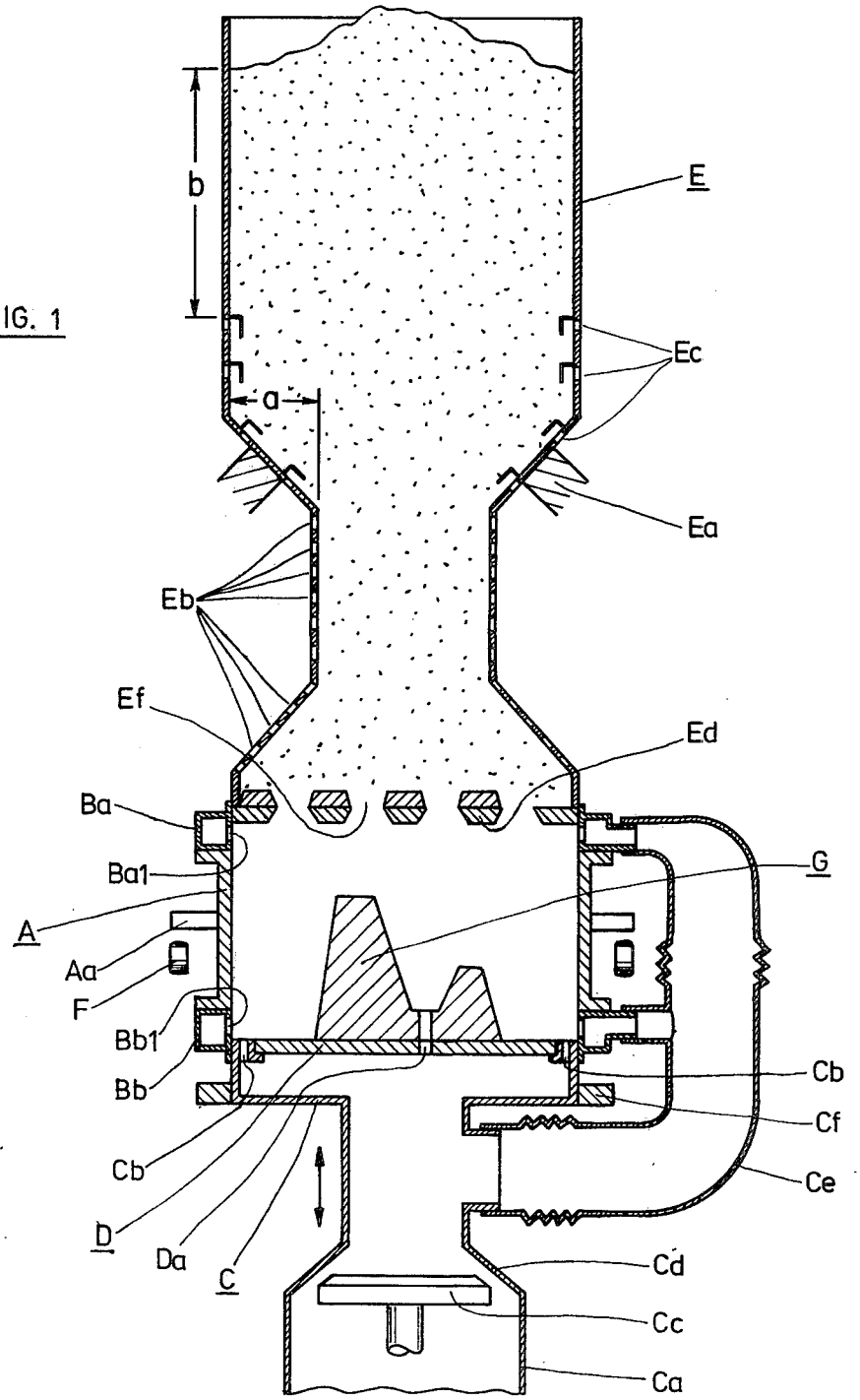
FIG. 1 is a schematic illustration of the inventive apparatus for manufacturing upper mold sections by using a form box.

The apparatus as shown in FIG. 1 for the manufacturing of upper mold sections by means of a mold box A is illustrated at the start of the injection process. When forming with form boxes, there are usually required filling frames B, in this case two, namely Ba and Bb, since one pattern plate carrier C serves also as a press die and must be able to dip into the lower filling frame Bb. Both filling frames Ba and Bb may, with large area pattern plates D, be connected to vacuum duct Ca, in that case they will be of a hollow construction and have evacuation nozzles $Ba_1$ or $Bb_1$ directed towards the inside of the mold box.

A sand chamber E is constructed as a venturi pipe and is fixedly connected at Ea to a foundation. The sand chamber also has air intake nozzles Eb of a smaller cross section located in its lower area for supplemental air supply and has in its upper area air intake nozzles Ec of a larger cross section for normal air intake. The separating wall Ed toward the mold box A forms a double grate comprising a section which is fixedly connected with the sand container, and a horizontally movable section (slide plate) which in one position completely releases slots Ef of the lower section while in another position covers these slots Ef. The slots of both grate sections have an optimum width of about 50 mm and always of an equal width.

The mold box A has horizontal supporting areas Aa, with which it is supported during inward and outward movement on a vertically immovable gravity-roll carrier F. Its two front areas are retained in a sealed condition by means of sealer elements of the sand frames Ba and Bb.

The pattern plate carrier C has at its edge a series of evacuation nozzles Cb and is vertically movable. The pattern plate D with a pattern G is insertable into the pattern plate carrier C and has only a few evacuation nozzles Da. A control valve Cc, Cd, and a flexible pipe Ce are fixedly connected with the pattern plate carrier C, the flexible pipe Ce leading thereby to the sand frames Ba, Bb. The arrangement operates as follows:

The double grate Ed is closed, sand is supplied into the sand chamber E, simultaneously the mold box A rolls horizontally in position on the gravity-roll carrier F, the mold box is then lifted by means of the instantly lifting pattern plate carrier C together with the lower sand frame Bb fixedly bolted onto the pattern plate carrier C, and is then pressed against the upper sand frame Ba which is fixedly bolted to the sand chamber E.

The control valve Cc, Cd then opens and a vacuum develops in the mold box A. Subsequently, the grate section Ed opens, and the injection is made, i.e., the mold box A instantaneously fills with sand. Before the further lifting of the pattern plate carrier C, the above-mentioned bolting to the lower sand frame Bb is released, so that the model-plate carrier C is able to submerge into the mold frame A up to a boss member Cf. When this is accomplished (and therewith the sand level being equal to the lower box edge level) then the bolting of the upper sand frame Ba will be released from the sand chamber E, and the double greate E submerges thereby under a further lifting of the model-plate carrier C as a counter die into the upper sand frame Ba.

In the following sinking out of the model-plate carrier C downwards, the two sand frames Ba, Bb return to their starting positions relative to the sand chamber E and the model-plate carrier C, and are there again bolted; simultaneously, the mold box A sinks onto the gravity-roll carrier F and, after the model-plate carrier C has meanwhile reached its lowermost position, it is from there pushed out horizontally. Thus, the cycle ends and a new one can begin.

Figure 2:
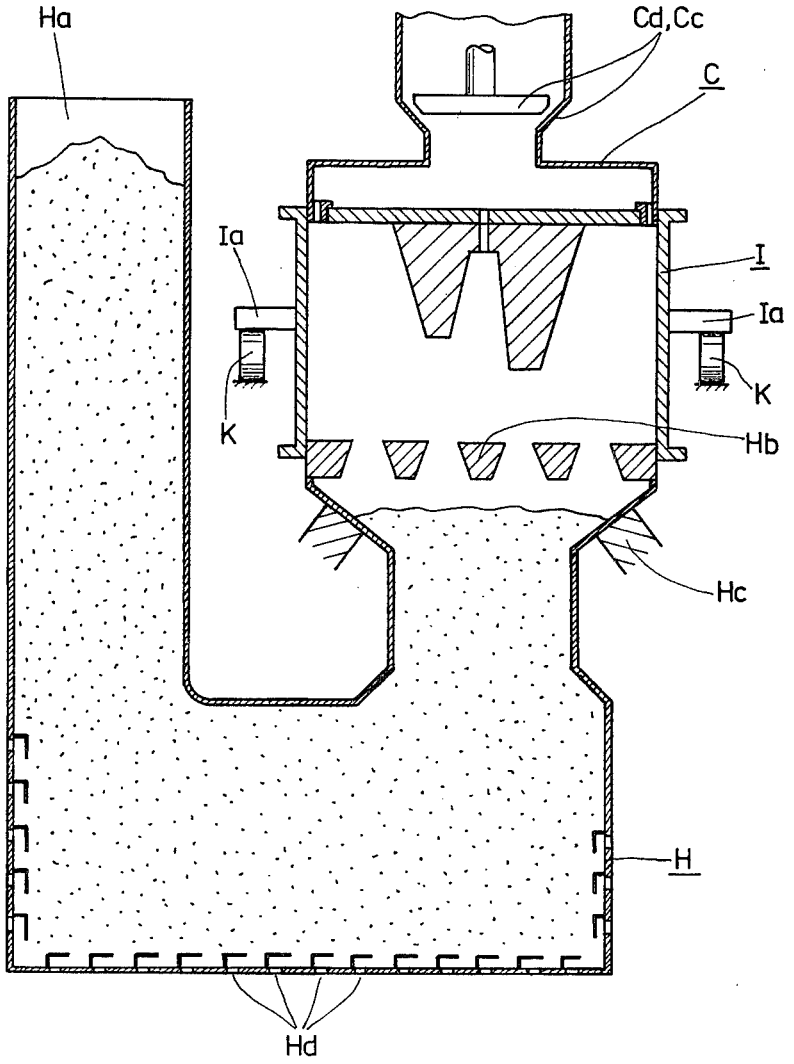
FIG. 2 is a schematic illustration of the inventive apparatus for manufacturing lower mold sections using boxless molds.

The apparatus shown in FIG. 2 for manufacturing bottom sections with mold frame (for flaskless molds) is illustrated before injection (initial vacuum is just opened). The sand frames are hereby not utilized, they are normally not required for flaskless molds. In general, the structure of the apparatus is in principle the same as the apparatus shown in FIG. 1, with the exception of the sand chamber H which in cross section is of a U-shaped design and is provided with an input opening Ha at its lateral U-legs, and has in its main leg, located below the mold frame I, a separating wall injection grate which is not sealable and is herein constructed as a pressing grate Hb. The sand chamber H is fixedly connected at Hc to a foundation. The reference symbol Hd denotes the air inlet nozzles of larger cross sections. The mold frame I has horizontal support areas Ia with which it supports itself on a vertically movable gravity-roll carrier K. The pattern plate carrier C is the same as in the apparatus shown in FIG. 1, with the exception of the supply pipe to the sand frames. The model-plate carrier also is vertically movable. The operation is as follows:

The inlet opening Ha is filled with sand. Simultaneously, the empty mold frame I is horizontally moved on the still lifted gravity-roll carrier K and the gravity-roll carrier K is lowered, whereby the mold frame I is pulled over the injection grate Hb and provides the sealing. The model-plate carrier C is then lowered to an extent so that the mold frame I is also lightly pulled over the grate Hb and provides the sealing. Now, the control valve Cc, Cd, to the initial evacuation is slightly opened and then fully opened, and the mold frame I is instantaneously filled with sand (primary compression). The model-plate carrier then sinks further downward into the mold frame I (pressing, secondary compression). Thereafter, the model-plate carrier is again lifted upwards (sinking out) and the mold is ready. The mold frame can then be moved out horizontally and the cycle can begin anew.

The apparatus according to FIG. 1 may, of course, function also with mold frames (for flaskless molds), and in the reverse situation the apparatus according to FIG. 2 can also function with mold boxes (for manufacturing box molds).

Figure 3:
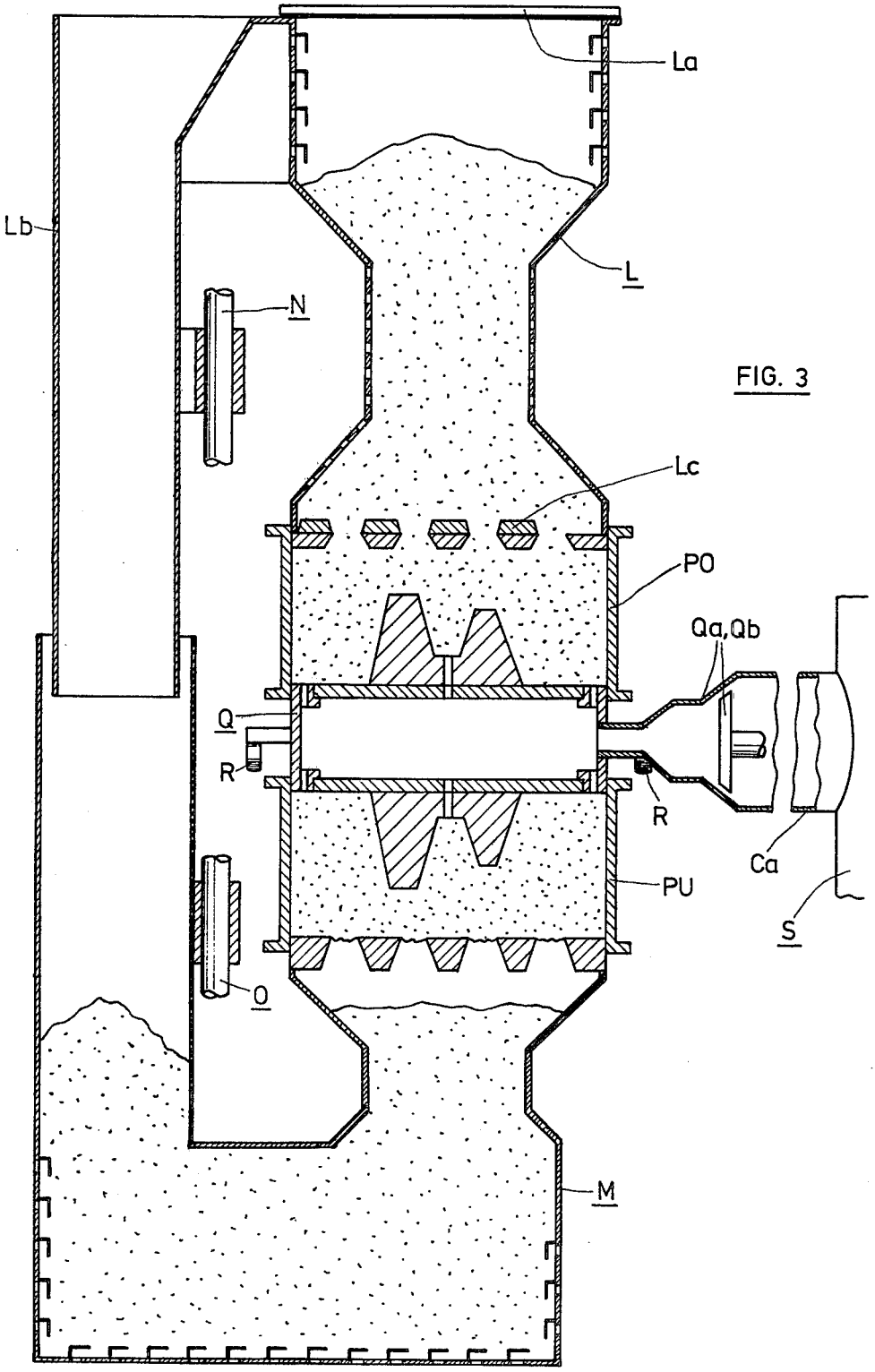
FIG. 3 is a schematic illustration of a match plate machine with a horizontally movable pattern plate in which the principles as shown in FIGS. 1 and 2 are combined.

FIG. 3 illustrates an apparatus which has been developed by combining the two devices of FIGS. 1 and 2 (with minor changes to the principle) for manufacturing complete flaskless casting molds comprising top and bottom sections shortly before the injection process.

An upper sand chamber L is herein shown in a reduced variant with a lid La and is provided with a flanged gravity tube (down pipe) Lb as a telescopic connection means to a lower sand chamber M.

The sand chambers L and M correspond in principle with the sand chambers E and H shown in FIGS. 1 and 2, with the exception that there both sand chambers are fixedly anchored to the foundation, while now they are vertically movable on guide means N and O, and function thereby simultaneously also as press units.

Mold frames PO and PU are in principle the same as those of the mold frame I shown in FIG. 2, with the exception that they are only vertically movable on guide means (not shown).

The pattern plate carrier Q corresponds in principle with the pattern plate carrier C as shown in FIGS. 1 and 2, however, with two exceptions, namely, the control valve Qa, Qb is necessarily flanged laterally and the pattern plate carrier Q is movable only horizontally on the moving units R. The operation of the apparatus is as follows:

The pattern plate carrier Q is horizontally moved in; both mold frames PO and PU are vertically moved upwards, or away. The sand chamber lid La is opened and the grate Lc is simultaneously closed. Sand is now supplied into both sand chambers L and M, both mold frames PO and PU are simultaneously closing up by means of pulling to an insignificant degree over the pattern plate carrier Q. Then the sand chamber lid La closes, whereafter the control valve Qa, Qb is insignificantly opened to produce an initial vacuum. Thereafter, the control valve Qa, Qb opens completely in order to produce a main vacuum, and shortly thereafter (about 0.1 sec) the grate Lc opens up and the injection phase begins, i.e., both mold frames are filled instantaneously.

The above-noted time difference of 0.1 sec is thereby balanced out in that during the acceleration of the sand from the bottom, the force of gravity is negative, while from the top it is positive.

After the injection process, the two sand chambers L and M move in the direction toward the pattern plate carrier Q, the two mold frames PO and PU respectively being fixedly bolted at the upper sand chamber L and at the lower sand chamber M, and thereby move along to be pulled further over the pattern plate carrier Q (press). After completion of these bilateral pressing processes there also follows the bilateral outside cycle, in which the two sand chambers L and M are now moving away from the pattern plate carrier in opposite directions, whereby the mold frames PO and PU are still retained in the bolted position, as above mentioned. Thereafter, the pattern plate carrier Q is moved out horizontally, both mold frames Po and PU move (again respectively together with the sand chambers L and M) toward each other and close up (cover). Then, the above-mentioned bolting of the two mold frames PO and PU on the sand chambers L and M is released, the two mold frames PO and PU, respectively, are pulled away from the completed mold by means of corresponding relative movements to the sand chambers L and M upwards or downwards, and the sand chamber lid La is simultaneously again opened and the double grate is again closed. After a short lifting of the upper sand chamber L, which is still necessary, the completed flaskless casting mold rests freely on the lower press grate and awaits the pattern plate carrier Q which moves in during the next cycle to push the casting mold out of the apparatus.

Figure 4:
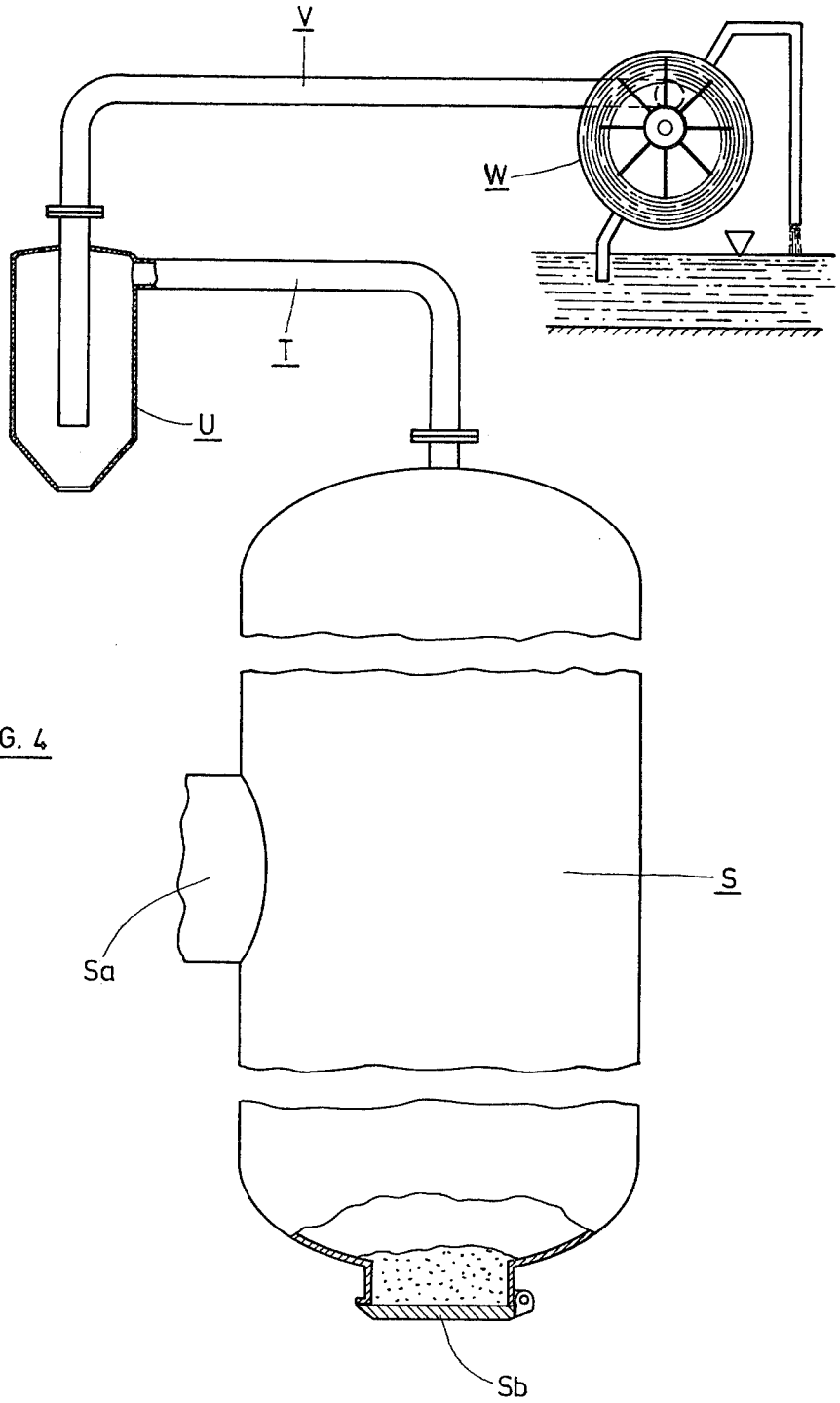
FIG. 4 is a schematic illustration of a large scale vacuum container of the inventive apparatus, as well as a cyclone and a liquid seal pump.

The evacuation device shown in FIG. 4, together with one of the apparatuses shown in either FIGS. 1, 2 or 3, forms one functional unit. It is thereby necessary that the volume of a large scale vacuum container S is at least 20 times the size of the mold box volume or mold frame volume.

A connector plug Sa produces the connection to the respective mold apparatus. A trap door Sb serves for the removal of the deposited dust and sand particles. A pipe T represents the connecting means to a cyclone U, and a pipe V leads from the cyclone U to a liquid seal pump W of a prior art construction. The manner of operation is as follows:

A sudden large squall of exhaust air coming from the mold apparatus moves into the large scale vacuum container S via the plug Sa, and settles down to some extent in the vacuum container, whereby sand and coarse dust particles, which have been moved along, are settling at the bottom.

Continuously over the entire cycle period of the mold apparatus, there is simultaneously drawn a comparatively small amount of air/time-unit from the large scale vacuum container S over the comparatively small cyclone U to the liquid seal pump W and is there guided into the open space. The cyclone U thereby eliminates the remaining fine dust particles, and the liquid seal pump W binds the remaining dust particles and guides the same away, together with the waste water.

A cyclone will not be required when the contents of the large-scale vacuum container S is at least 30 times greater than the hollow space of the mold box or mold frame, since the initial separation in the large scale vacuum container is then sufficiently strong.

Preferably, the amount of sand in the sand chamber below the upper edge of the venturi neck is equal to the amount of sand in the mold container.

Preferably with an amount of sand of 200 liters to be injected from the top, the total cross-section of air intake nozzles with larger cross-section Ec is 500 $cm^2$ and the total cross-section of those with smaller cross-section Eb is 120 $cm^2$. Similar ratios apply for other sand volumes. For 200 liters of sand to be injected from the bottom, air inlet nozzles Hd should have a total cross-section of 900 $cm^2$. A similar ratio would apply for other sand volumes.

What I claim is:

1. In a method of manufacturing a casting mold from a binder-container molding sand, in which injection takes place through a grate which seals a sand chamber and which grate also functions as a press plate, the molding sand being injected into a mold container under a venturi pipe effect, whereby the oppositely positioned other opening of the mold container is sealed by means of a pattern plate which is connected to a vacuum source, and whereby after the filling of the mold container a secondary compressing of the sand takes place by means of a relative movement between the pattern plate and the injection grate, and after separation from the pattern plate two mold sections are completed into a casting mold, the improvement comprising the steps of:

(a) providing the injection grate with closable injection slots having a width of at least 50 mm;

(b) connecting the hollow space of the mold container to a vacuum source, and initially evacuating the mold container to a low pressure of at least 0.08 atmospheres;

(c) for the purpose of injecting the sand, confining the sand in the sand chamber in the venturi neck to a cross-sectional area of from about 1000 $cm^2$ to 2000 $cm^2$ so as to produce the venturi pipe effect before penetration through the injection grate; and instantaneously stressing the hollow space of the mold container with the full vacuum of at least 0.2 atmospheres vacuum, and retaining this vacuum after injecting the sand; and (d) removing the vacuum after the secondary compressing and prior to separating the mold section from the pattern plate.

2. The method according to claim 1 wherein the connecting step comprises:

filterlessly connecting the hollow space of the mold container to a large scale vacuum container containing a sand deposit cavity and having at least 20 times the volume of the hollow space of the mold container, and initially evacuating the mold container to a low pressure of at least 0.08 atmospheres, and continuously evacuating the large scale vacuum container by means of a liquid seal pump.

3. The method according to claim 2, further comprising mechanically removing any sand carried between the large scale vacuum container and the liquid seal pump from the stream therebetween.

4. The method according to claim 1, additionally connecting said mold container to said vacuum container by evacuation openings in a mold frame of said mold container.

5. The method according to claim 1, further comprising laterally stressing and penetrating the molding sand volume located in the sand chamber by atmospheric air during the injecting.

6. The method according to claim 1 for manufacturing upper and lower mold sections, characterized in that the mold container comprises a mold flask and the secondary compression is achieved by moving the pattern plate.

7. The method according to claim 1 for manufacturing flaskless molds, characterized in that the mold container comprises at least one mold frame and the secondary compression is achieved by moving the press plate which is connected to the mold frame.

8. The method according to claim 1, characterized in that the molding sand, during the additional venturi acceleration, is constrained in a venturi neck whose length is at least ¼ as long as the circumference of the venturi neck.

9. The method according to claim 8, characterized in that the amount of molding sand in the sand chamber below the upper edge of the venturi neck is equal to the amount of sand in the mold container and that the molding sand volume in the sand chamber is stressed with atmospheric air via openings of the sand chamber with larger cross sections located in the area above the upper venturi widening, and via openings with smaller cross sections in the area of the venturi neck as well as openings having a smaller cross section in the area of the lower venturi widening; and reducing the pressure developed in the sand chamber over the entire lateral extent beyond the injection from the upper edge of the sand to the injection grate by regulating the air flow of a larger cross section to those having a smaller cross section, which pressure reduction during the injection prevents interruption in the sand flow above the venturi neck.

10. The method according to claim 9, characterized in that the sand chamber being open at the top, the upper edge of the sand volume located in the sand chamber lies about three times as high above the uppermost lateral air intake openings of the sand chamber as the horizontal radial distance of these air intake openings from the outer rim of the venturi neck.

11. In a method of manufacturing a casting mold from a binder-containing molding sand, in which injection takes place through a grate which seals a sand chamber and which grate also functions as a press plate, the molding sand being injected into a mold container under a venturi pipe effect, whereby the oppositely positioned other opening of the mold container is sealed by means of a pattern plate which is connected to a vacuum source, and whereby after the filling of the mold container a secondary compressing of the sand takes place by means of a relative movement between the pattern plate and the injection grate, and after separation from the pattern plate two mold sections are completed into a casting mold, the improvement comprising the steps of:

(a) filterlessly connecting the hollow space of the mold container to a large scale vacuum container containing a sand deposit cavity and having at least 20 times the volume of the hollow space of the mold container, and initially evacuating the mold container to a low pressure of at least 0.08 atmospheres, and continuously evacuating the large scale vacuum container by means of a liquid seal pump;

(b) for the purpose of injecting the sand, confining the sand in the chamber in the venturi neck to a cross-sectional area of from about 1000 $cm^2$ to 2000 $cm^2$ so as to produce the venturi pipe effect before penetration through the injection grate; and instantaneously stressing the hollow space of the mold container with the full vacuum of at least 0.2 atmospheres vacuum, and retaining this vacuum after injecting the sand; and (c) removing the vacuum after the secondary compressing and prior to separating the mold section from the pattern plate.

12. The method according to claim 11, of manufacturing mold sections which are injected from below, characterized in that the sand chamber is U-shaped in elevation, whereby its bite portion is located below the mold cotainer and its lateral leg is located below the sand injection grate, and retaining the volume of the molding sand located in the lateral leg of the sand chamber to at least 1½ volume of the mold container, and the sand level in the lateral leg higher than that in the bite portion.

13. The method according to claim 12, characterized in that the molding sand located in the sand chamber is stressed with atmospheric air by means of openings which are located in the bite portion of the sand chamber below the lower venturi enlargement, and by means of openings located in the area of the U-curve of the sand chamber as well as in the area of the lateral leg.

14. The method according to claim 11 further comprising mechanically removing any sand carried between the large scale vacuum container and the liquid seal pump from the stream therebetween.

15. The method according to claim 11, further comprising laterally stressing and penetrating the molding sand volume located in the sand chamber by atmospheric air during the injecting.

16. The method according to claim 11 for manufacturing upper and lower mold sections, characterized in that the mold container comprises a mold flask and the secondary compression is achieved by moving the pattern plate.

17. The method according to claim 11 for manufacturing flaskless molds, characterized in that the mold container comprises at least one mold frame and the secondary compression is achieved by moving the press plate which is connected to the mold frame.

18. The method according to claim 11, characterized in that the amount of molding sand in the sand chamber below the upper edge of the venturi neck is equal to the amount of said in the mold container and that the molding sand volume in the sand chamber is stressed with atmospheric air via openings of the sand chamber with larger cross sections located in the area above the upper venturi widening, and via openings with smaller cross sections in the area of the venturi neck as well as openings having a smaller cross section in the area of the lower venturi widening; and reducing the pressure developed in the sand chamber over the entire lateral extent beyond the injection from the upper edge of the sand to the injection grate by regulating the air flow of a larger cross section to those having a smaller cross section, which pressure reduction during injection prevents interruption in the sand flow above the venturi neck.

19. The method according to claim 11, characterized in that the sand chamber being open at the top, the upper edge of the sand volume located in the sand chamber lies about three times as high above the uppermost lateral air intake openings of the sand chamber as the horizontal radial distance of these air intake openings from the outer rim of the venturi neck.

20. In an apparatus for manufacturing casting molds from a binder-containing molding sand, comprising at least one sand chamber in the shape of a venturi pipe, a mold container, an injection grate means between said mold container and venturi pipe functioning in the form of a press plate and sealing one opening of a mold container, and having a hollow pattern plate which seals the other opening of the mold container, the inside of the hollow pattern plate being connected with the inside of the mold container by evacuation nozzles, a vacuum source, an evacuation duct connecting the inside of said pattern plate and said vacuum source, and a control valve in said duct and the press plate and the pattern plate are arranged to be displaced relative to each other, the improvement comprising:

(a) injection slots in the injection grate means having a minimum width of at least 50 mm; and said apparatus further comprising, (b) said injection grate means including a slide plate as a closing means; which is slidable parallel to the plane of the injection grate means, and providing substantially vacuum tight sealing.

21. The apparatus according to claim 20, further comprising:

(a) the pattern plate being removably inserted into the mold container and evacuation nozzles of the pattern plate being located near the edge of the pattern plate;

(b) the numerical value of the cross section of the evacuation duct, measured in square centimeters, being at least as large as the numerical value of the volume measured in liters of the mold container;

(c) the vacuum source being constructed as a large scale container having a capacity of at least 20 times that of the mold container and having a sand and dust removal means at its lowermost point, the vacuum source being connected to a liquid seal pump; and (d) an air filter being connected between the large scale vacuum container and the liquid seal pump in the evacuation duct.

22. The apparatus according to claim 21, characterized in that the pattern plate comprises a plate-shaped assembly which is fastenable to a hollow evacuatable pattern plate carrier, and receiving a pattern, the edge of the pattern plate carrier enclosing the assembly in a frame-like fashion, the edge being provided with most of the evacuation nozzles.

23. The apparatus according to claim 21, characterizied in that a two-stage valve controls the evacuation and vacuum injection.

24. The apparatus according to claim 21, characterized in that the air filter comprises a cyclone separator.

25. The apparatus according to claim 20, characterized in that the mold container comprises a mold flask and further comprising form frames which frame the mold flask at the top and at the bottom, which are respectively constructed as hollow frames, having a hollow frame space which is removably connected to the evacuation duct and having evacuation apertures connecting the hollow frame space to the space surrounded by such frame.

26. The apparatus according to claim 20, characterized in that the mold container comprises a mold frame and the section of the mold frame which faces the press plate and the section of the mold frame which faces the pattern plate are respectively constructed as a hollow frame, each having a frame hollow space removably connected to the evacuation duct and evacuation apertures connecting said hollow space to the space surrounded by the section frame.

27. The apparatus according to claim 20, characterized in that the section of the sand chamber, which is adjacent to the venturi widening facing the injection grate has a larger cross section than the section of the sand chamber which is adjacent to the other venturi widening at the other side of the venturi neck.

28. The apparatus according to claim 20, characterized in that the axial length of the venturi neck of the sand chamber is at least equal to $\frac{1}{4}$ of the circumference of the neck; that the venturi widening of the sand chamber, which faces the mold container has an angle of tilt of at least the angle of friction of the molding sand to be injected, and that this section is measured in a manner so that its capacity plus the capacity of the venturi neck is equal to the mold container capacity.

29. The apparatus according to claim 20 further comprising air intake nozzles of a large cross section arranged in the area above the upper venturi widening and in the area of the upper venturi widening in the sand chamber; and air intake nozzles of a smaller cross section arranged in the area of the venturi neck as well as in the area of the lower venturi widening in the sand chamber, and with an amount of sand of 200 liters to be injected, the total cross section of the air intake nozzles with the larger cross section is 500 $cm^2$, and the total cross section of the air intake nozzles with the smaller cross section is 120 $cm^2$, and that this ratio is equivalently applicable for other sand volumes.

30. In an apparatus for manufacturing casting molds from a binder-containing molding sand, comprising at least one sand chamber in the shape of a venturi pipe, a mold container, an injection grate between said mold container and said venturi pipe functioning in the form of a press plate and sealing one opening of a mold container, and having a hollow pattern plate which seals the other opening of the mold container, the inside of the hollow pattern plate being connected with the inside of the mold container by evacuation nozzles, a vacuum source, an evacuation duct connecting the inside of said pattern plate and said vacuum source, and a control valve in said duct and the press plate and the pattern plate are arranged to be displaced relative to each other, the improvement comprising:

(a) the pattern plate being removably inserted into the mold container and evacuation nozzles of the pattern plate being located near the edge of the pattern plate;

(b) the numerical value of the cross section of the evacuation duct, measured in square centimeters, being at least as large as the numerical value of the volume measured in liters of the mold container;

(c) the vacuum source being constructed as a large scale container having a capacity of at least 20 times that of the mold container and having a sand and dust removal means at its lowermost point, the vacuum source being connected to a liquid seal pump; and (d) an air filter being connected between the large scale vacuum container and the liquid seal pump in the evacuation duct.

31. The apparatus according to claim 30, for injection from the bottom upward, further comprising air intake nozzles arranged in the wall of the U-shaped sand chamber in the bite portion located below the injection grate below its venturi widening, in the area of the U-curve and in the area of the lateral leg, the air intake nozzles having a total cross section of 900 $cm^2$ for an amount of 200 liters of sand to be injected and that this ratio is equivalently applicable for other sand volumes.

32. The apparatus according to claim 30 for manufacturing casting forms according to the match plat method and in which respectively the press plate and the venturi section of the upper and the lower sand chamber are movable relative to the apparatus frame, characterized in that the press plate, the sand chamber and the inherent gravity tube sections are combined into a mutually movable unit.

33. The apparatus according to claim 30, characterized in that the pattern palte comprises a plate-shaped assembly which is fastenable to a hollow evacuatable pattern plate carrier, and receiving a pattern, the edge of the pattern plate carrier enclosing the assembly in a frame-like fashion, the edge being provided with most of the evacuation nozzles.

34. The apparatus according to claim 30, characterized in that a two-stage valve controls the evacuation and vacuum injection.

35. The apparatus according to claim 30, characterized in that the air filter comprises a cyclone separator.

36. The apparatus according to claim 30, characterized in that the section of the sand chamber, which is adjacent to the venturi widening facing the injection grate has a larger cross section than the section of the sand chamber which is adjacent to the other venturi widening at the other side of the venturi neck.

* * * * *